US005808222A

United States Patent [19]

Yang

[11] Patent Number: 5,808,222

[45] Date of Patent: Sep. 15, 1998

[54] METHOD OF BUILDING A DATABASE OF TIMBRE SAMPLES FOR WAVE-TABLE MUSIC SYNTHESIZERS TO PRODUCE SYNTHESIZED SOUNDS WITH HIGH TIMBRE QUALITY

[75] Inventor: Ming-Jer Yang, Hsinchu, Taiwan

[73] Assignee: Winbond Electronics Corporation, Hsinchu, Taiwan

[21] Appl. No.: 927,049

[22] Filed: Sep. 10, 1997

[51] Int. Cl.[6] ..... G10H 7/00

[52] U.S. Cl. ..... 84/603; 84/607

[58] Field of Search ..... 84/603–607, 622

[56] References Cited

U.S. PATENT DOCUMENTS

| | | | |
|---|---|---|---|
| 5,324,882 | 6/1994 | Ohta et al. | 84/604 |
| 5,371,315 | 12/1994 | Hanzawa et al. | 84/603 |
| 5,466,882 | 11/1995 | Lee | 84/603 |
| 5,519,166 | 5/1996 | Furuhashi et al. | 84/603 |
| 5,672,836 | 9/1997 | Yoshida | 84/607 |

*Primary Examiner*—Brian Sircus
*Assistant Examiner*—Jeffrey W. Donels
*Attorney, Agent, or Firm*—Rabin & Champagne, P.C.

[57] ABSTRACT

A method of building a database of timbre samples for music synthesizers is provided, which can help provide smooth transitions between adjacent looping waveforms in the looping segment of the synthesized sound waveform, and also help provide an optimal tradeoff between high timbre quality and low timbre vibrations. The method utilizes a cosine looping-waveform transformation function to obtain an optimized looping waveform that can be repetitively appended to the timbre sample with smooth transitions between adjacent looping waveforms such that the resultant synthesized sound waveform is free from ripples that will otherwise affect the reproduced timbre quality of the synthesized sound. Moreover, the method utilizes a timbre-balancing function that can help provide an optimal tradeoff between high timbre quality and low timbre vibrations. The reproduced timbre quality of the synthesized sound from the wave-table music synthesizer is thus very high.

14 Claims, 13 Drawing Sheets

Synthesized Sound Waveform from the Timbre Sample S

METHOD OF BUILDING A DATABASE OF TIMBRE SAMPLES FOR WAVE-TABLE MUSIC SYNTHESIZERS TO PRODUCE SYNTHESIZED SOUNDS WITH HIGH TIMBRE QUALITY

BACKGROUND OF THE INVENTION

1. Field of the Invention

This invention relates to wave-table music synthesizers, and more particularly, to a method for building a database of timbre samples from various musical instruments for use by a music synthesizer to produce synthetic sounds of music that are similar in timbre quality to the actual musical instruments.

2. Description of Related Art

Among conventional music synthesizing means, the wave-table music synthesizer can provide synthetic sounds of music with relatively high-fidelity tones. Fundamentally, the wave-table music synthesizer first records the tones generated by the musical instruments (the recorded waveform is hereinafter referred to as "primitive sound waveform"); then extracts and digitizes a sample of a fixed length, for example 0.1 sec, from the primitive sound waveform (each extracted waveform is hereinafter referred to as a "timbre sample"); and finally stores the digitized sound data in a memory unit. Afterwards, the wave-table music synthesizer can produce synthesized sounds of music that are similar in timbre quality to those produced by the actual musical instruments. This is achieved simply by retrieving selected timbre samples from the memory and then converting them by audio reproduction means into audible sounds in such a manner that the entire timbre sample is audibly converted once and then the last one complete cycle or few cycles (referred to as looping waveform) are repeatedly audibly converted.

FIG. 1 shows one example of a primitive sound waveform recorded from a certain musical instrument, a timbre sample extracted from the primitive sound waveform, and a synthesized sound waveform produced from the timbre sample. In the case of FIG. 1, the last complete cycle in the timbre sample is selected as the looping waveform. Each synthesized sound waveform is produced in such a manner that the entire timbre sample is audibly converted once and then the looping waveform is audibly converted repeatedly. As shown in FIG. 1, synthesized sound waveform has a leading segment which is identical in shape as the leading part of the timbre sample and a looping segment which includes a number of continuous repetitions of the looping waveform. The sound quality of the looping segment is a key factor to the overall sound quality of the synthesized sound. Fundamentally, the wave-table music synthesizer can produce a high-fidelity synthesized sound only when the timbre samples and looping waveforms being used satisfy the following four conditions:

Condition 1: The length of the looping waveform should be an integral multiple of the fundamental period of the timbre sample.

If this condition is not satisfied, the leading segment and the looping segment of the synthesized sound will result in different pitches. For instance, in the case of making a timbre sample for the A4 (440 Hz) pitch, the fundamental period of the timbre sample will be $1/440$=2.27 ms (millisecond). Under a sampling frequency of 44,000 Hz, each fundamental period of the timbre sample will contain 100 sampling points. Therefore, in this case, the length of the looping waveform (in unit of number of sampling points) should be at least a multiple of 100 sampling points.

Condition 2: All of the adjacent looping waveforms in the looping segment of the synthesized sound waveform should have smooth transitions from one looping waveform to the next.

If this condition is not satisfied, the synthesized sound will be slightly noisy due to the unsmooth transitions from one looping waveform to the next. Sound quality will therefore be degraded.

Condition 3: The looping segment of the synthesized sound waveform should be able to be used to accurately reproduce the timbre of the musical instrument.

Condition 4: To simply the hardware complexity and increase the utilization efficiency of the wave-table music synthesizer, the timbre samples as well as the looping waveforms from the various concerned musical instruments should have unified lengths.

If any of the above-mentioned conditions is not satisfied, the synthesized sound will possess a degraded sound reproduction quality. In reality, however, it is quite difficult to satisfy all of the above-mentioned conditions at the same time.

A conventional method for building a database of timbre samples from a certain musical instrument is described below. This conventional method includes the following procedural steps:

Step 1: Set a standard unified looping-waveform length for all of the various concerned musical instruments as the minimum common multiple of the values of the various fundamental periods of the various timbre samples recorded from these musical instruments (this scheme allows the resultant looping waveforms to satisfy the above-mentioned Condition 1 and Condition 4).

Step 2: Select a predetermined fixed length starting from the beginning point of the primitive sound waveform, for example 0.1 sec, as a standard timbre-sample length. The waveform extracted from this length serves as one timbre sample (also referred to as "first-prototype timbre sample), as illustrated in FIG. 2.

Step 3: Select the last complete cycle in the waveform of the timbre sample as the looping waveform, as illustrated in FIG. 3.

Step 4: Convert the entire timbre sample once into audible sound and then convert the looping waveform repeatedly into audible sound. The result is a synthesized sound as illustrated in FIG. 4, whose timbre quality is similar to that produced by the actual musical instrument.

The foregoing conventional method, however, is only able to satisfy the above-mentioned Condition 1 and Condition 4, but not Condition 2 and Condition 3. This is due to the following two problems.

First, since a musical instrument will generate tones with varying periods and waveforms, the looping segment of the synthesized sound may not have smooth transitions from one looping waveform to the next, thereby causing the occurrence of ripples in the joints between adjacent looping waveforms, as illustrated in FIG. 5. When reproduced by audio reproduction means, these ripples will cause the synthesized sound to possess a noisy effect, thus degrading the timbre quality of the synthesized sound. The Condition 2 is thus not satisfied.

Second, it has been learned from experiments that, when the looping-waveform length is equal to one fundamental period, the synthesized sound will be more smoothly reproduced. However, as illustrated in FIG. 6, it will make the synthesized sound monotonous, and thus dull, to the listener. Therefore, as shown in FIG. 7, if the looping waveform is selected to include two or more fundamental periods in the timbre sample, the synthesized sound will be more close in timbre quality to the pitches produced by the actual musical instrument. This scheme can help the looping waveform to satisfy the Condition 3. However, it will cause the drawback of producing timbre vibrations that are periodically produced at a period equal to the length of the selected looping waveform. The occurrence of these timbre vibrations will cause degradation to the timbre quality of the synthesized sound. Therefore, in the design of the wave-table music synthesizer, a tradeoff should be made between high timbre quality and low timbre vibrations by selecting a suitable length for the looping waveform.

SUMMARY OF THE INVENTION

It is therefore a primary objective of the present invention to provide a method of building a database of timbre samples for music synthesizers which can help provide smooth transitions between adjacent looping waveforms in the looping segment of the synthesized sound waveform.

It is another objective of the present invention to provide a method of building a database of timbre samples for music synthesizers which can help provide an optimal tradeoff between high timbre quality and low timbre vibrations, allowing the timbre sample to satisfy all of the four required conditions.

In accordance with the foregoing and other objectives of the present invention, a new method of building a database of timbre samples for music synthesizers is provided.

Broadly speaking, the method of the invention includes the following procedural steps:

(1) setting a predetermined length for the timbre samples that are to be recorded from the various concerned musical instruments;

(2) recording and digitizing the tones of the various concerned musical instruments to thereby obtain a number of primitive sound waveforms;

(3) from the beginning point of each of the primitive sound waveforms, extracting the predetermined length of waveform to thereby obtain a first-prototype timbre sample;

(4) selecting the minimum common multiple of the values of the various fundamental periods of the various timbre samples recorded from all of the concerned musical instruments as a standard looping-waveform length, and then selecting an endmost segment of the looping-waveform length from the end of the first-prototype timbre sample to thereby obtain a prototype looping waveform;

(5) obtaining a preceding waveform segment of equal length to the prototype looping waveform; and then applying a cosine looping-waveform transformation function on the prototype looping waveform and the preceding waveform segment to thereby obtain an optimized looping waveform;

(6) replacing the prototype looping waveform in the first-prototype timbre sample with the optimized looping waveform to thereby obtain a second-prototype timbre sample; and (7) applying a timbre-balancing function on the second-prototype timbre sample and a third-prototype timbre sample having an optimized one-period looping waveform to thereby obtain a timbre-optimized timbre sample in accordance with:

$$X=T*W+S*(1-W),$$

where

X is the timbre-optimized timbre sample;

T is the third-prototype timbre sample;

S is the second-prototype timbre sample; and

W is a weight value, and $0 \leqq W \leqq 1$.

In the foregoing method, the tones from the various concerned musical instruments are digitized at an equal sampling frequency, and the total number of sampling points for the tones from the various concerned musical instruments are arbitrarily selected. Moreover the total number of sampling points for the tones from the various concerned musical instruments can be the same.

The cosine looping-waveform transformation function is mathematically expressed as:

$$F[k]=L[k]*\frac{1+\cos\left(\frac{k*\pi}{N}\right)}{2}+P[k]*\frac{1-\cos\left(\frac{k*\pi}{N}\right)}{2}$$

$$\text{for } k=1, 2, \ldots, N$$

where

N is the total number of sampling points in the length of the prototype looping waveform;

F[1]-F[N] represent the N sampling points of the optimized looping waveform;

L[1]-L[N] represent the N sampling points of the prototype looping waveform; and P[1]-P[N] represent the N sampling points of the preceding waveform segment.

Moreover, the third-prototype timbre sample having optimized one-period looping waveform is obtained by the steps of:

obtaining an extracted waveform which is the second-prototype timbre sample excluding the endmost looping waveform;

applying the cosine looping-waveform transformation function on the first complete cycle of the fundamental period that immediately following the extracted waveform to thereby obtain an optimized one-period looping waveform; and repetitively appending the optimized one-period looping waveform to the end of the extracted waveform until the extended waveform is equal in length to the second-prototype timbre sample, the extended waveform of equal length to the second-prototype timbre sample serving as the third-prototype timbre sample.

The weight value W is variously selected between 0 and 1 depending on the particular type of the concerned musical instrument. For instance, for flutes and pianos, the weight value W will be close to 1 (i.e., $0.5<W\leqq 1$); whereas for violins and various other treble instruments, the weight value W will be close to 0 (i.e., $0\leqq W<0.5$).

In accordance with another aspect of the invention, the method of the invention includes the following procedural steps of:

(1) recording and digitizing the tones of the various concerned musical instruments at a specific sampling frequency to obtain a number of primitive sound waveforms;

(2) from the beginning point of each of the primitive sound waveforms, extracting a predetermined length of the waveform to thereby obtain a first-prototype timbre sample;

(3) extracting an endmost segment of a predetermined length from the end of the first-prototype timbre sample to thereby obtain a prototype looping waveform;

(4) obtaining a preceding waveform segment of equal length to the prototype looping waveform; and then applying a cosine looping-waveform transformation function on the prototype looping waveform and the preceding waveform segment to thereby obtain an optimized looping waveform;

(5) replacing the prototype looping waveform in the first-prototype timbre sample with the optimized looping waveform to thereby obtain a second-prototype timbre sample;

(6) extracting the first cycle of the fundamental period and a preceding waveform segment of equal length to the first cycle from the second-prototype timbre sample; and then the cosine looping-waveform transformation function on the two extracted waveforms to thereby obtain an optimized one-period looping waveform; and repetitively appending the optimized one-period looping waveform to the end of the third-prototype timbre sample until the extended waveform is equal in length to the second-prototype timbre sample to thereby obtain a third-prototype timbre sample.

(7) applying a timbre-balancing function on the second-prototype timbre sample and the third-prototype timbre sample to thereby obtain a timbre-optimized timbre sample in accordance with:

$$X=T*W+S*(1-W),$$

where

X is the timbre-optimized timbre sample;

T is the third-prototype timbre sample;

S is the second-prototype timbre sample; and

W is a weight value, and $0 \leqq W \leqq 1$.

In the foregoing method, the tones from the various concerned musical instruments are digitized at an equal sampling frequency, and the total number of sampling points for the tones from the various concerned musical instruments are arbitrarily selected. Moreover the total number of sampling points for the tones from the various concerned musical instruments can be the same.

The cosine looping-waveform transformation function is mathematically expressed as:

$$F[k] = L[k]*\frac{1+\cos\left(\frac{k*\pi}{N}\right)}{2} + P[k]*\frac{1-\cos\left(\frac{k*\pi}{N}\right)}{2}$$

for $k = 1, 2, \ldots, N$ where

N is the total number of sampling points in the length of the prototype looping waveform;

F[1]-F[N] represent the N sampling points of the optimized looping waveform;

L[1]-L[N] represent the N sampling points of the prototype looping waveform; and P[1]-P[N] represent the N sampling points of the preceding waveform segment.

Moreover, the third-prototype timbre sample having optimized one-period looping waveform is obtained by the steps of:

obtaining an extracted waveform which is the second-prototype timbre sample excluding the endmost looping waveform;

applying the cosine looping-waveform transformation function on the first complete cycle of the fundamental period that immediately following the extracted waveform to thereby obtain an optimized one-period looping waveform; and repetitively appending the optimized one-period looping waveform to the end of the extracted waveform until the extended waveform is equal in length to the second-prototype timbre sample, the extended waveform of equal length to the second-prototype timbre sample serving as the third-prototype timbre sample.

The weight value W is variously selected between 0 and 1 depending on the particular type of the concerned musical instrument. For instance, for flutes and pianos, the weight value W will be close to 1 (i.e., $0.5<W\leqq 1$); whereas for violins and various other treble instruments, the weight value W will be close to 0 (i.e., $0\leqq W<0.5$).

BRIEF DESCRIPTION OF DRAWINGS

The invention can be more fully understood by reading the following detailed description of the preferred embodiments, with reference made to the accompanying drawings, wherein.

DETAILED DESCRIPTION OF PREFERRED EMBODIMENTS

In accordance with the invention, a method of building a database of timbre samples for music synthesizers is provided, which can help provide smooth transitions between adjacent looping waveforms in the looping segment of the synthesized sound waveform, and also help provide an optimal tradeoff between high timbre quality and low timbre vibrations, allowing the resultant timbre samples to satisfy all of the above-mentioned four conditions. These two aspects of the invention will be described respective in the following.

Figure 1A:
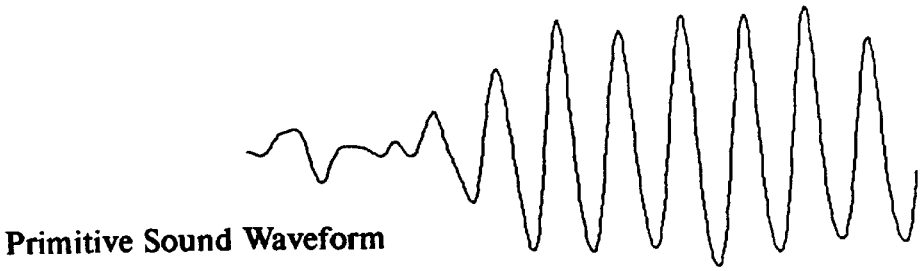
FIG. 1A (PRIOR ART)
FIG. 1 is a waveform diagram showing the primitive sound waveform recorded from a certain musical instrument, the waveform of a timbre sample extracted from the primitive sound waveform, and the waveform of a synthesized sound reproduced by a wave-table music synthesizer from the timbre sample.
Figure 1B:
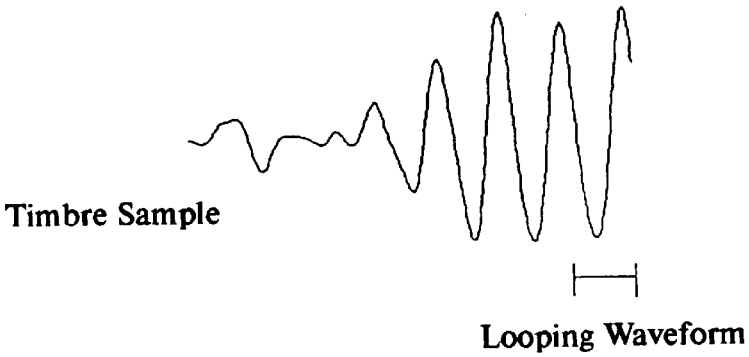
FIG. 1B (PRIOR ART)
Figure 1C:
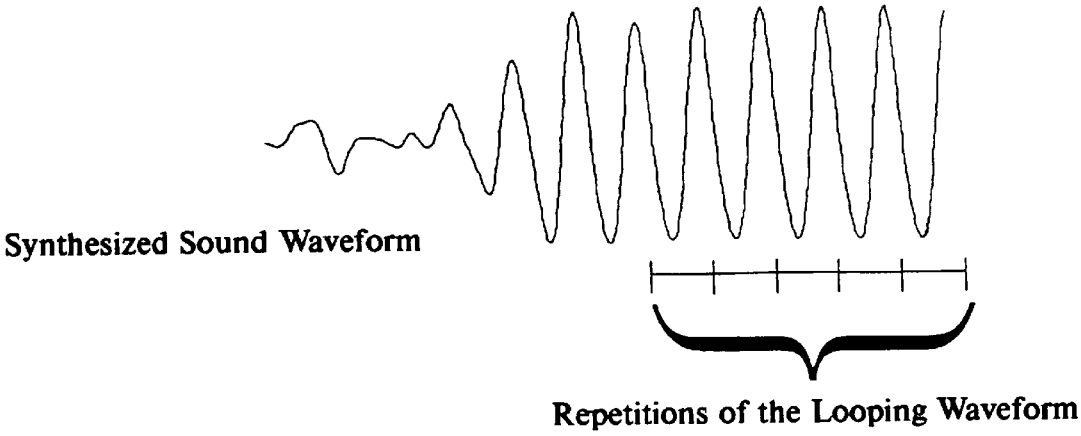
FIG. 1C (PRIOR ART)
Figures 2A, 2B:
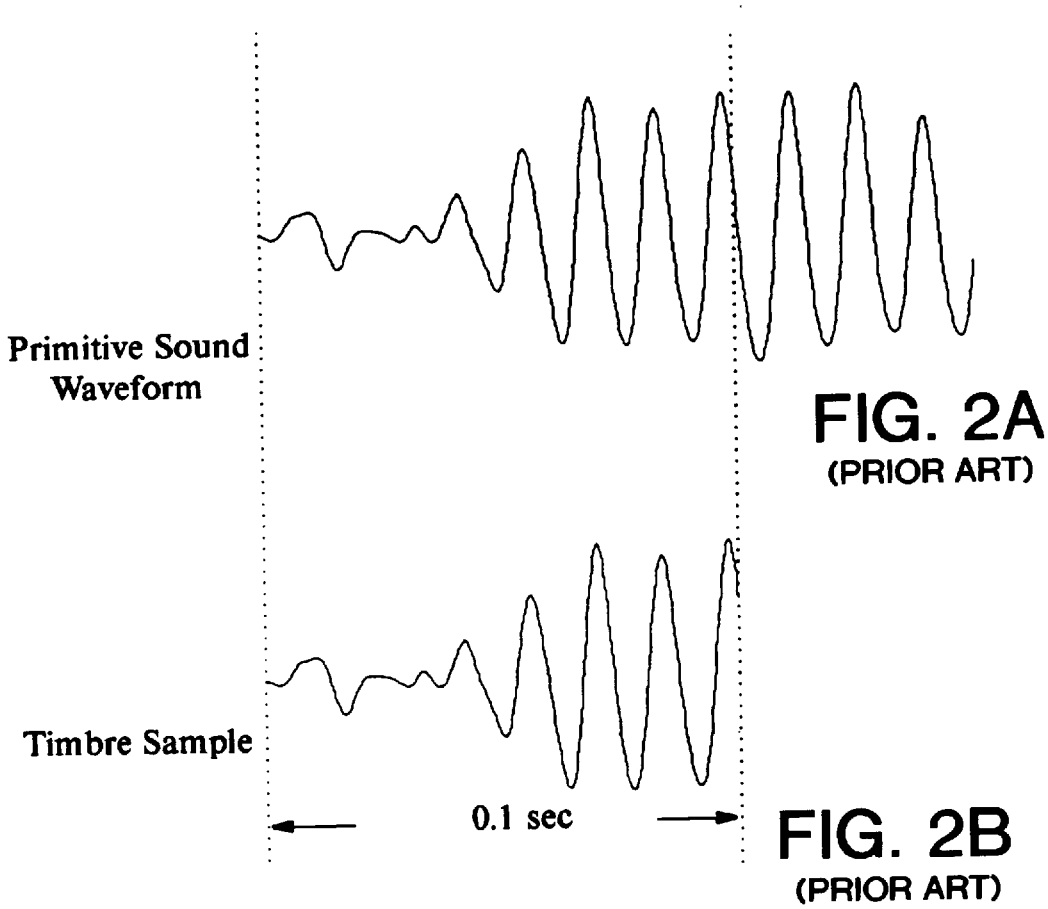
FIG. 2A (PRIOR ART)
FIG. 2B (PRIOR ART)
FIG. 2 is a waveform diagram used to explain how a timbre sample is extracted from the primitive sound waveform.
Figure 3:
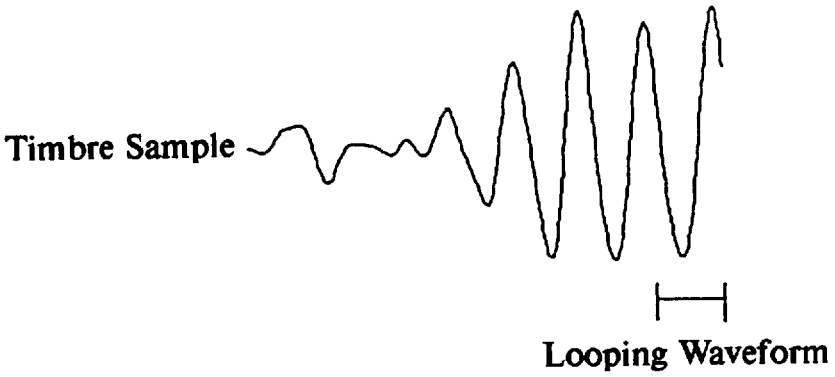
FIG. 3 (PRIOR ART)
FIG. 3 is a waveform diagram used to explain how a looping waveform is selected from the timbre sample.
Figure 4:
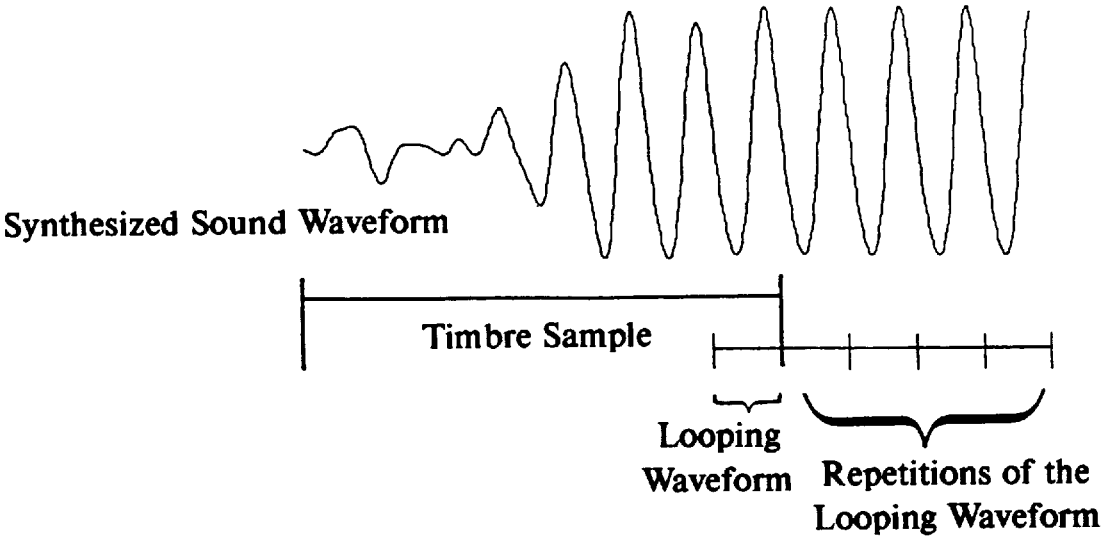
FIG. 4 (PRIOR ART)
FIG. 4 is a waveform diagram used to explain how the timbre sample and a number of repetitions of a looping waveform are related to the synthesized sound waveform.
Figure 5A:
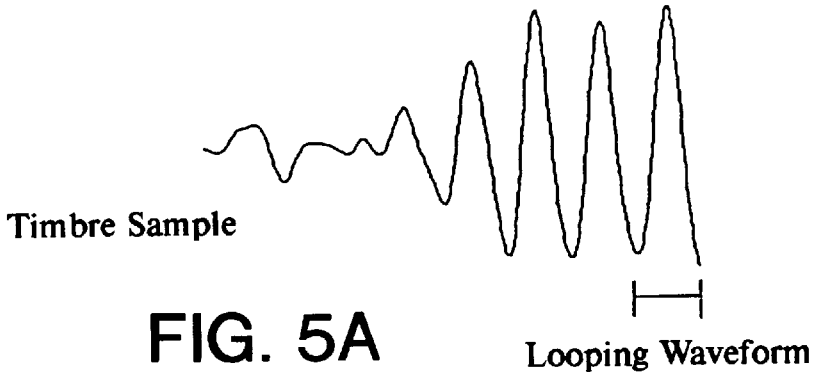
FIG. 5A (PRIOR ART)
FIG. 5 is a waveform diagram used to explain how the timbre quality of the synthesized sound waveform will be degraded when the repetitions of the looping waveform in the synthesized sound waveform are not smoothly joined.
Figure 5B:
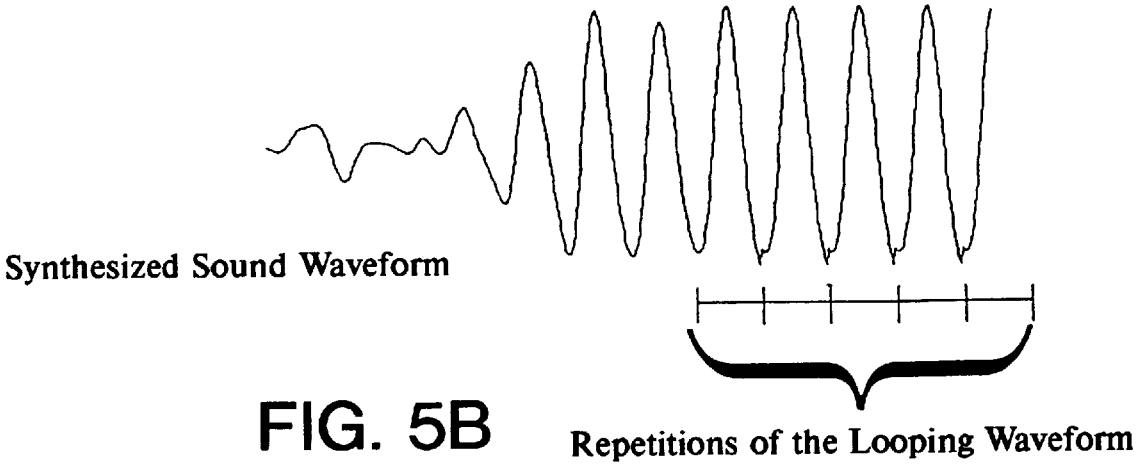
FIG. 5B (PRIOR ART)
Figure 5C:
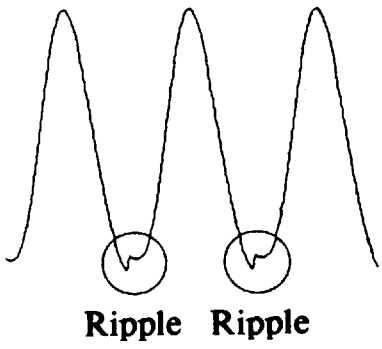
FIG. 5C (PRIOR ART)
Figure 6A:
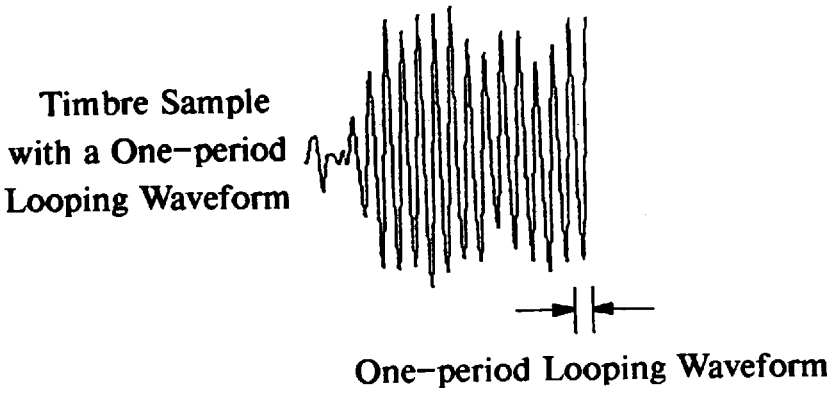
FIG. 6A (PRIOR ART)
FIG. 6 is a waveform diagram showing the waveform of a timbre sample whose looping-waveform length is equal to one fundamental period of the timbre sample and the waveform of a synthesized sound reproduced from this looping waveform.
Figure 6B:
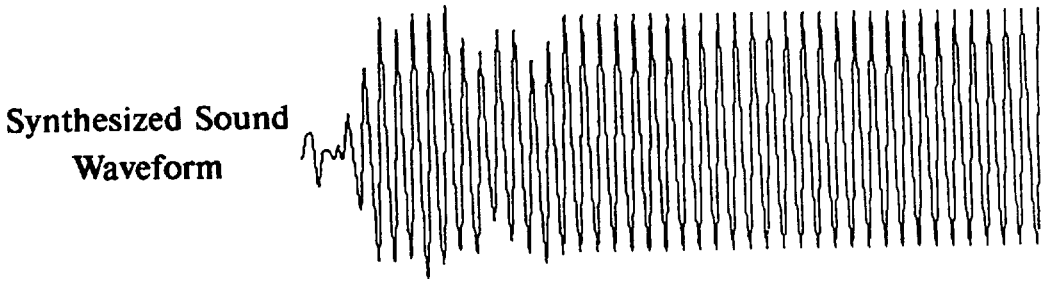
FIG. 6B (PRIOR ART)
Figure 7A:
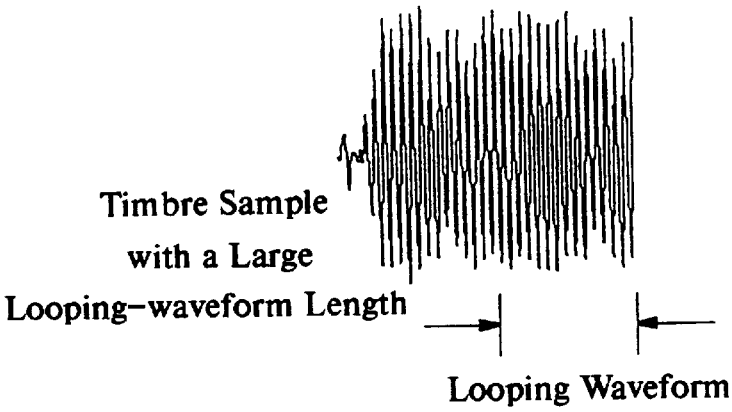
FIG. 7A (PRIOR ART)
FIG. 7 is a waveform diagram showing the waveform of a timbre sample whose looping-waveform length is equal to more than one fundamental period of the timbre sample and the waveform of a synthesized sound reproduced from this looping waveform.
Figure 7B:
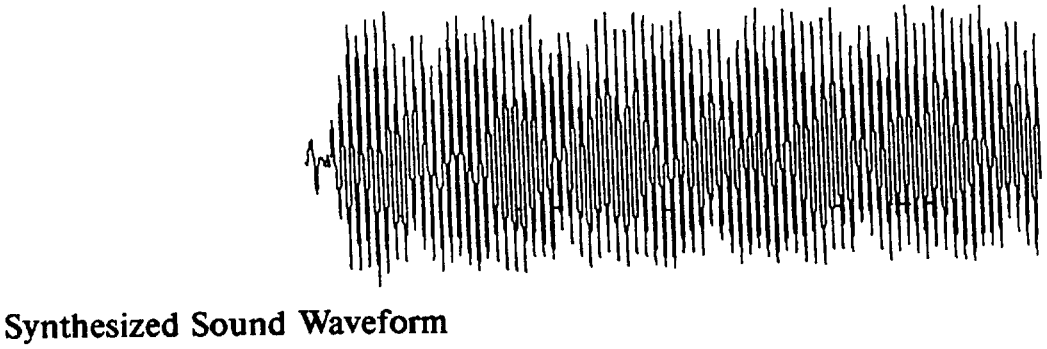
FIG. 7B (PRIOR ART)
Figure 8:
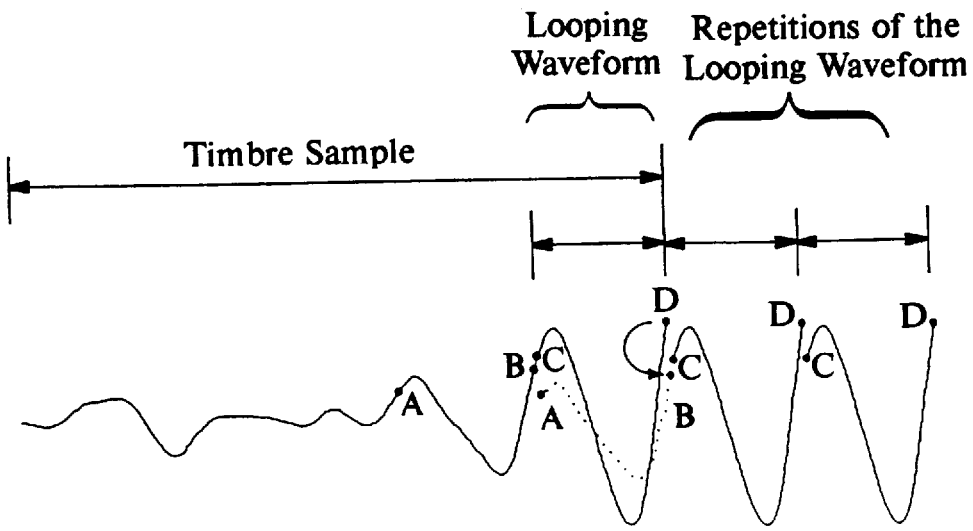
FIG. 8 is a waveform diagram showing the waveform of a timbre sample that satisfies the Condition 1 and Condition 4.

Providing smooth transitions between adjacent repetitions of the looping waveform FIG. 8 is a waveform diagram showing the waveform of a timbre sample that satisfies only the Condition 1 and Condition 4. As shown, the selected looping waveform (i.e., the prototype looping waveform) is the last complete cycle in the end of the timbre sample. If the point C in the looping waveform is selected as the starting point of each repetition of the looping waveform, the resulted cycles can be joined in a smooth manner. However, since the end point D of each looping waveform is located slightly far away from the beginning point C of the next repetition of the looping waveform, it is required that the looping waveform be transformed in such a manner that allows the end point D to be displaced to near the beginning point of the next repetition of the looping waveform, as illustrated in FIG. 8.

Figure 9A:
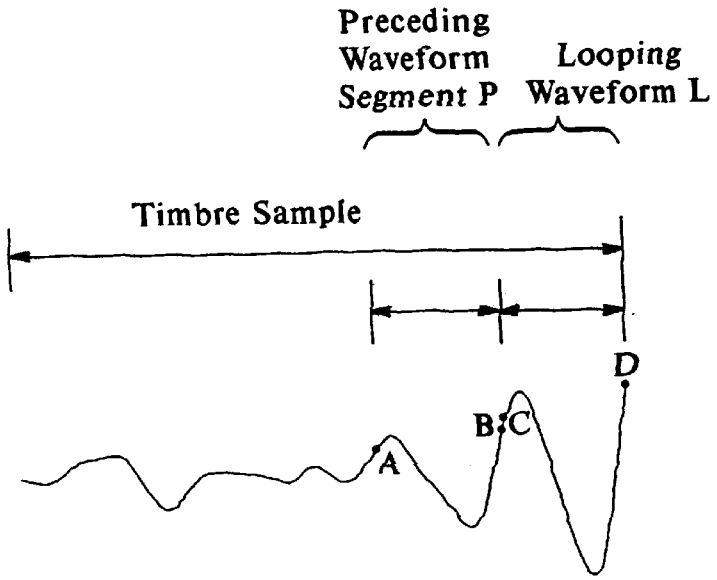
FIG. 9 is a schematic diagram used to depict the use of the cosine looping-waveform transformation function in accordance with the invention to obtain an optimized looping waveform.
Figure 9B:
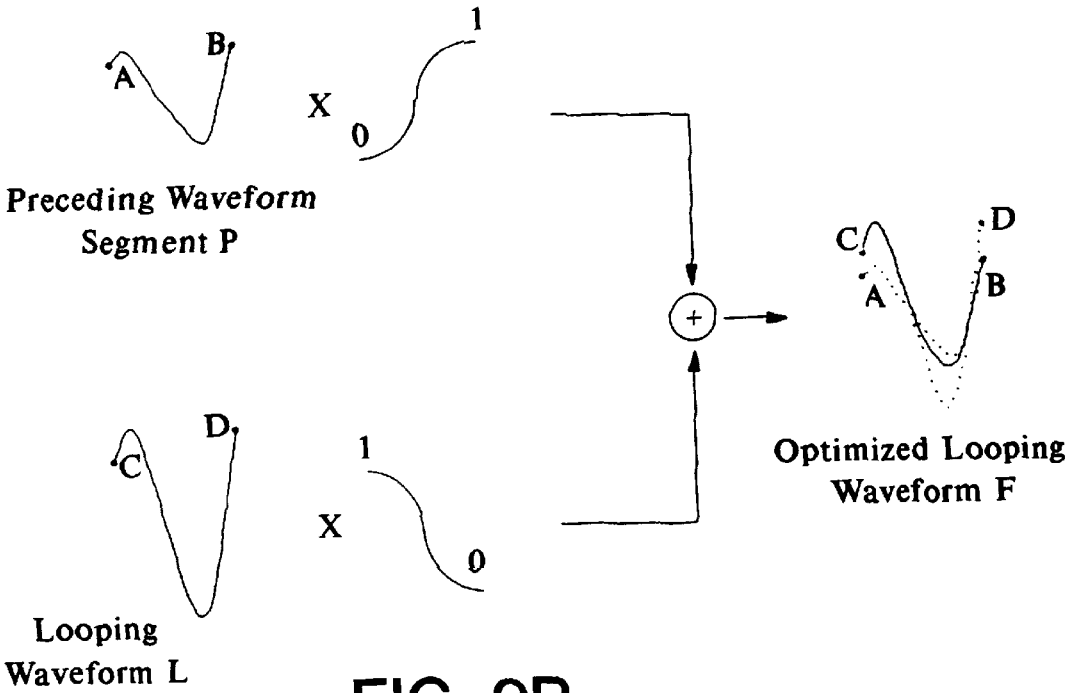

Referring to FIG. 9, in accordance with the invention to achieved the above-mentioned transformation, the prototype looping waveform L together with a preceding waveform segment P of equal length are transformed by a transformation function into a new looping waveform F (hereinafter referred to as "optimized looping waveforms") that allows the end point D of the original looping waveform to be displaced to near the point C of the next repetition of the optimized looping waveform.

Assume the prototype looping waveform L is N sampling points in length; and L[1]-L[N] represent the N sampling points of the prototype looping waveform L, P[1]-P[N] represent the N sampling points of the preceding waveform segment P, and F[1]-F[N] represent the N sampling points of the optimized looping waveform F. In accordance with the invention, the optimized looping waveform F is related to the prototype looping wave-form L and the preceding wave-form segment P by a transformation function as given in the following:

$$F[k] = L[k]^* \frac{1+\cos\left(\frac{k^*\pi}{N}\right)}{2} + P[k]^* \frac{1-\cos\left(\frac{k^*\pi}{N}\right)}{2}$$

for $k = 1, 2, \ldots, N$

In the foregoing transformation function, the cosine function is used since all of its derivative functions are continuous, smooth curves. It has been proved that the use of the cosine function in the transformation function allows the smoothest transitions from one repetition of the looping waveform to the next. Therefore, this transformation function is hereinafter referred to as a "cosine looping-waveform transformation function".

Figure 10A:
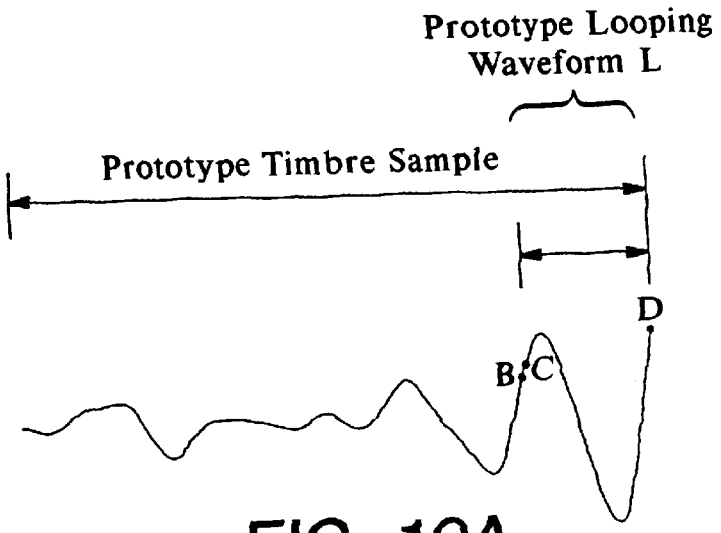
FIG. 10 is a waveform diagram showing the waveform of a prototype looping waveform and the waveform of an optimized looping waveform resulted from applying the cosine looping-waveform transformation function on the prototype looping waveform.
Figure 10B:
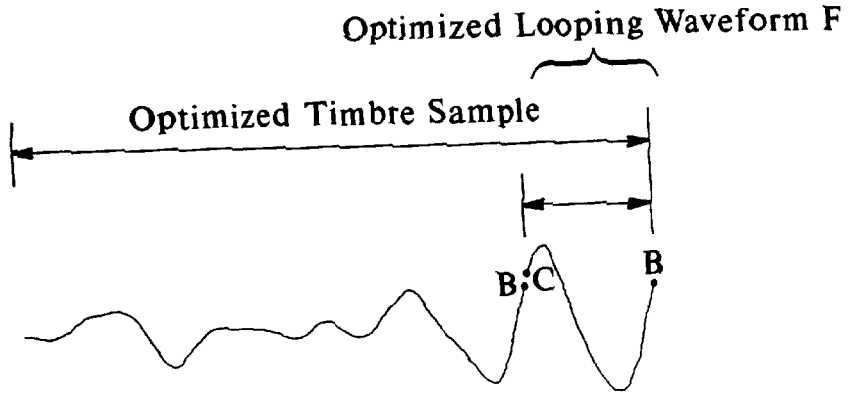
Figure 11:
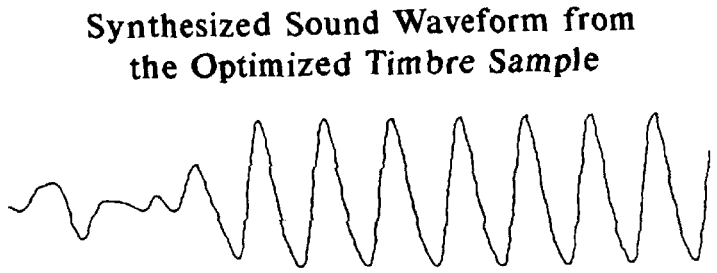
FIG. 11 is a waveform diagram showing the waveform of a synthesized sound obtained from the optimized looping waveform shown in FIG. 10.

FIG. 10 shows an example of applying the cosine looping-waveform transformation function on the prototype looping waveform L of FIG. 8 to obtain an optimized looping waveform F having an end point near the starting point B of the subsequent repetition of the looping waveform. The synthesized sound waveform produced from this optimized looping waveform F is shown in FIG. 11. It can be seen from FIG. 11 that the adjacent looping waveforms in the looping segment of the synthesized sound waveform are smoothly joined without the occurrence of ripples that will otherwise cause a noisy effect to the synthesized sound, resulting in a degradation to the reproduced timbre quality of the synthesized sound. Therefore, the invention represents a solution that will allow the timbre sample to satisfy the Condition 2.

Providing optimal tradeoff between high timbre quality and low timbre vibrations In accordance with the invention, the optimal tradeoff between high timbre quality and low timbre vibrations is achieved by applying a timbre-balancing function. This timbre-balancing function is described in details in the following.

Figure 12:
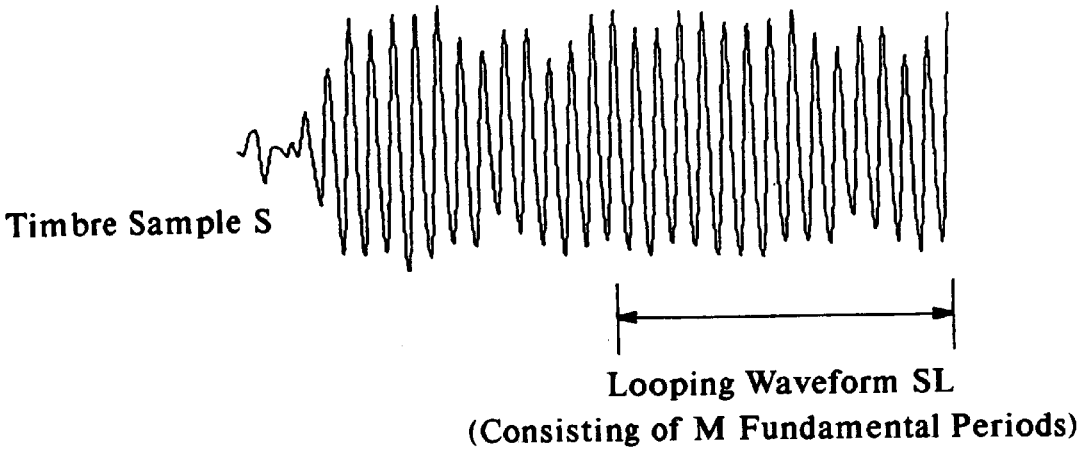
FIG. 12 is a waveform diagram showing the waveform of a timbre sample (second-prototype timbre sample) which contains a looping segment of M continuous repetitions of an optimized looping waveform that is resulted from the cosine looping-waveform transformation function.
Figure 13:
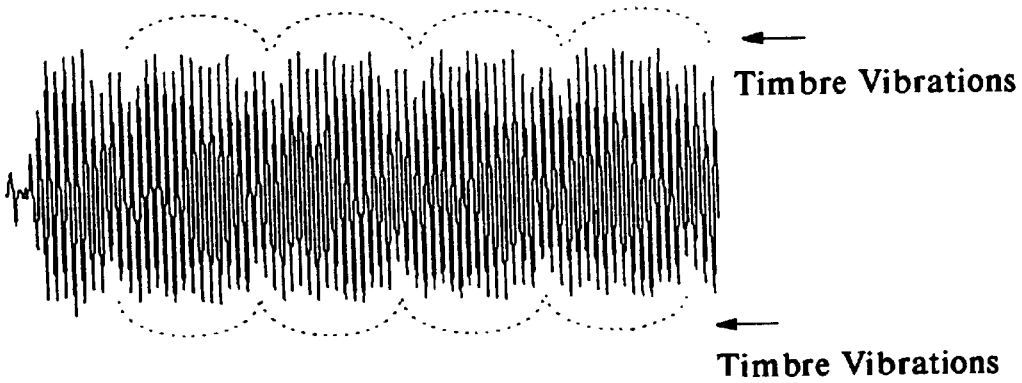
FIG. 13 is a waveform diagram showing the waveform of a synthesized sound produced from the timbre sample of FIG. 12.

FIG. 12 shows an example of a timbre sample S which contains a looping segment SL of M continuous repetitions of an optimized looping waveform that is resulted from the cosine looping-waveform transformation function (this timbre sample S is hereinafter referred to as "second-prototype timbre sample"). The length of the looping segment SL is M fundamental periods. An example of a synthesized sound waveform that is produced from the timbre sample S and the looping segment SL is shown in FIG. 13. The undulations in the envelop of the synthesized sound waveform are the cause of the timbre vibrations.

Figure 14A:
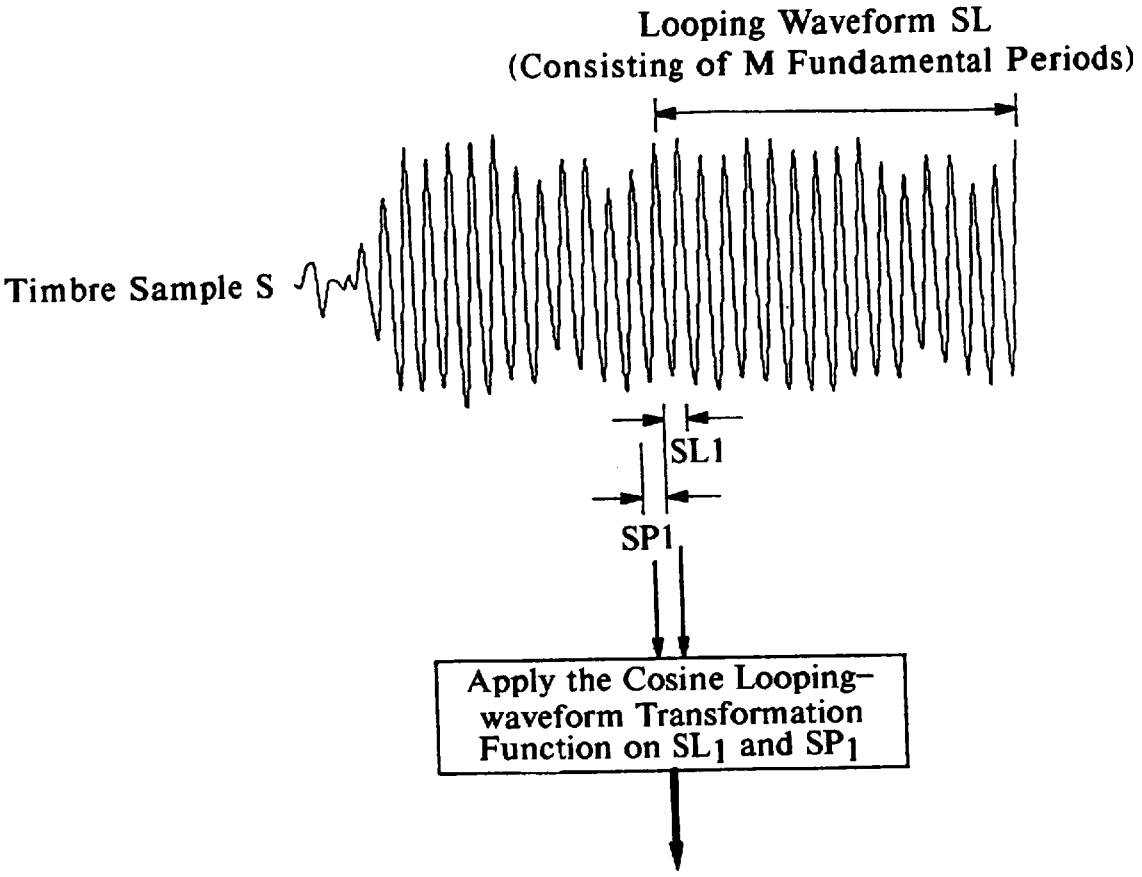
FIG. 14 is a waveform diagram showing how a third-prototype timbre sample T is obtained by applying the cosine looping-waveform transformation function on selected waveform parts from the second-prototype timbre sample S.
Figure 14B:
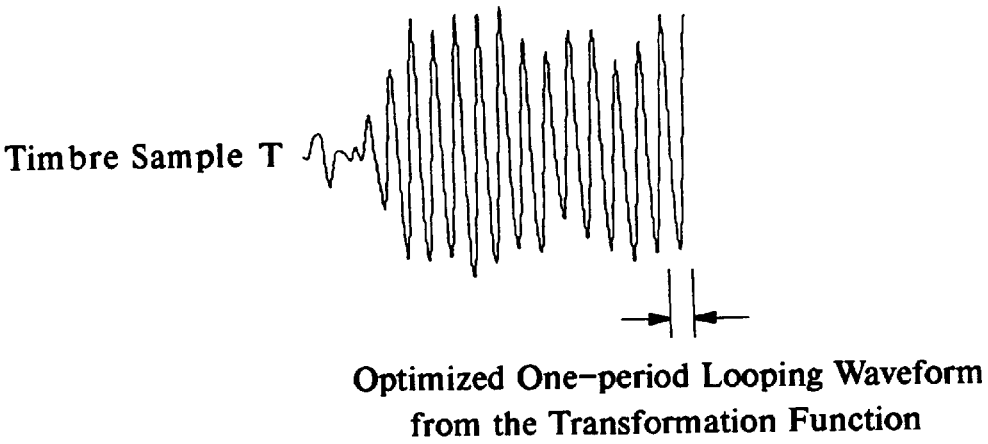

Referring to FIG. 14, in the subsequent step, the first cycle SL1 of the fundamental period and a preceding waveform segment SP1 of equal length to the cycle SL1 are extracted from the second-prototype timbre sample S. Then, the cosine looping-waveform transformation function is applied on SL1 and SP1 to thereby obtain an optimized looping waveform SF1 which is one fundamental period in length (the optimized looping waveform SF1 is hereinafter referred to as "optimized one-period looping waveform"). The resulted new timbre sample T that includes the optimized one-period looping waveform SF1 is referred to as the "third-prototype timbre sample".

Figures 15A, 15B:
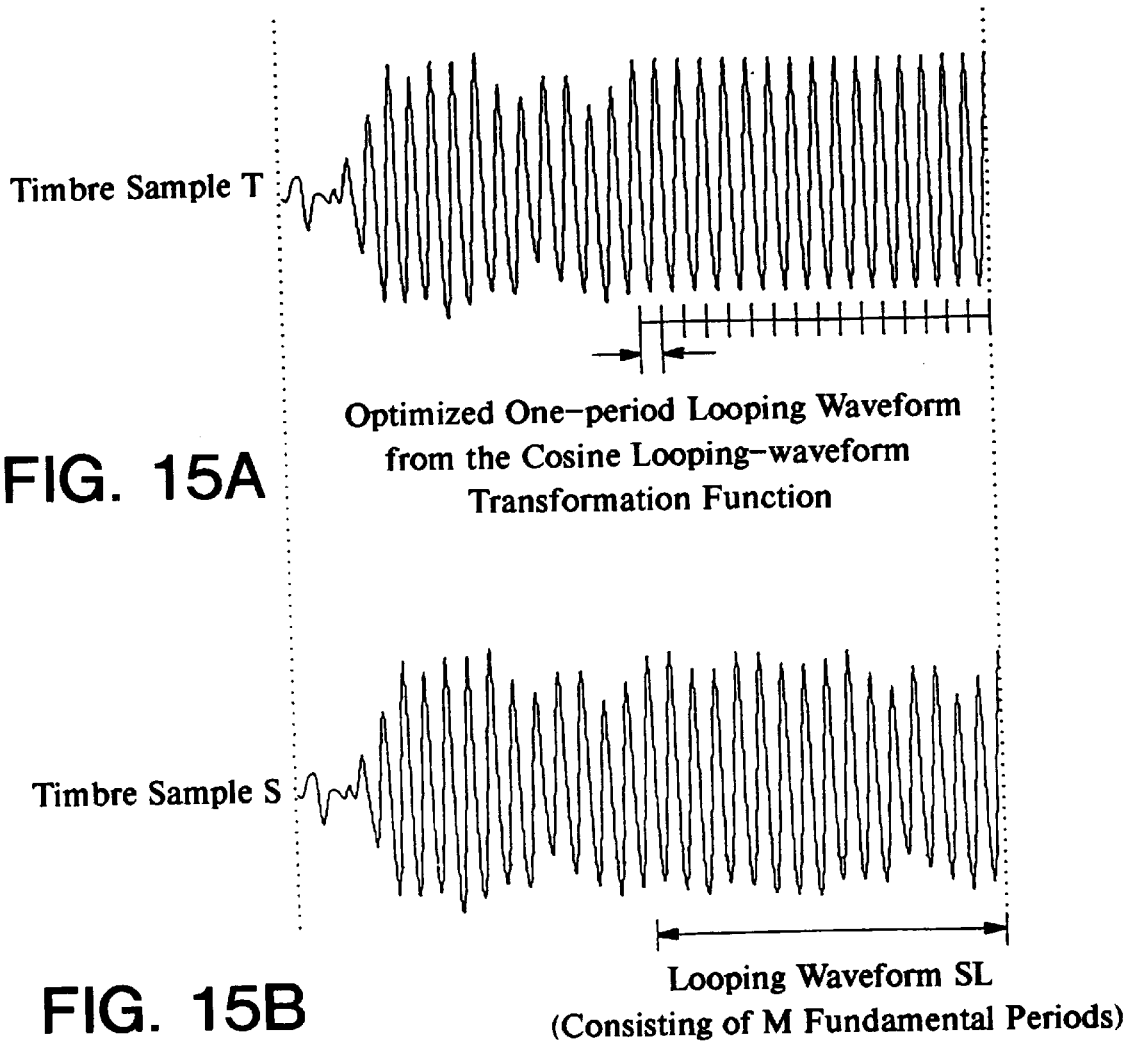
FIG. 15 is a waveform diagram used to depict how the third-prototype timbre sample is extended to equal in length to the second-prototype timbre sample S.

Referring next to FIG. 15, in the subsequent step, the optimized one-period looping waveform SF1 is repeated for M-1 times in succession to the third-prototype timbre sample T, allowing the extended third-prototype timbre sample T to be equal in length to the second-prototype timbre sample S. It can be learned from the waveforms shown in FIG. 15 that the synthesized sound reproduced from the second-prototype timbre sample S will be less monotonous but with more timbre vibrations; whereas the synthesized sound reproduced from the third-prototype timbre sample T will be more monotonous but with less timbre vibrations.

Figure 16A:
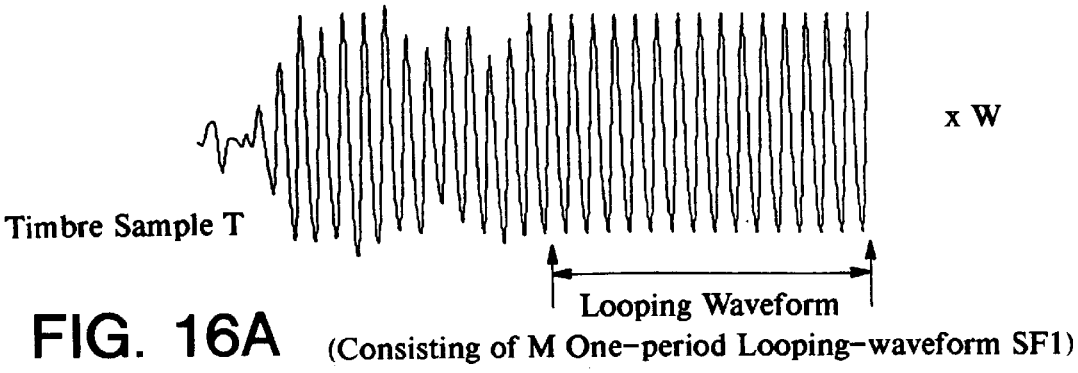
FIG. 16 is a waveform diagram used to depict how a timbre-optimized timbre sample is obtained by applying the timbre-balancing function in accordance with the invention on the second-prototype timbre sample S and the third-prototype timbre sample T.
Figure 16B:
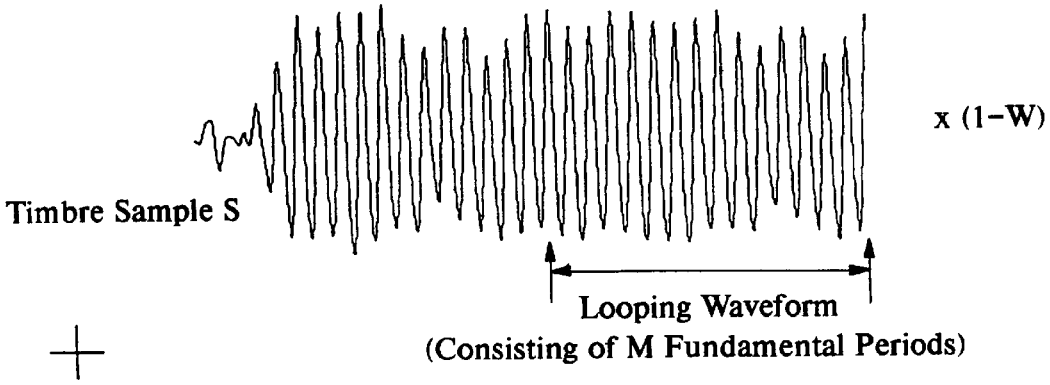
Figure 16C:
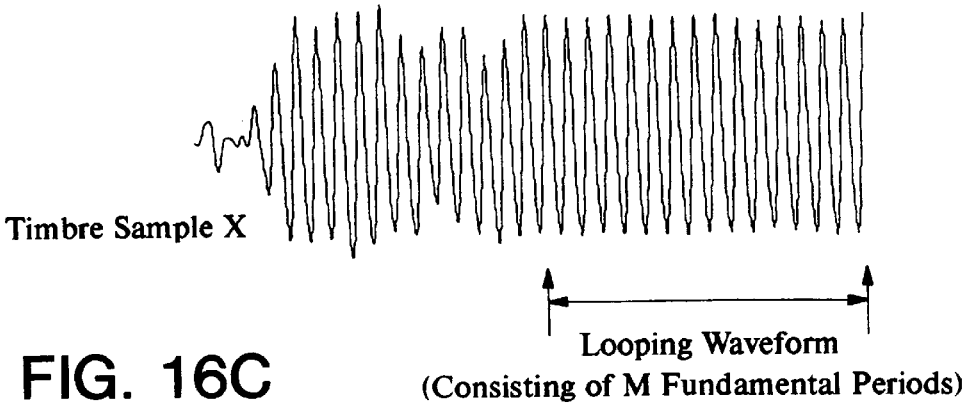

Referring finally to FIG. 16, in the subsequent step, a timbre-balancing function in accordance with the invention is applied on the second-prototype timbre sample S and the third-prototype timbre sample T to thereby obtain a timbre-optimized timbre sample X as follows:

$$X=T*W+S*(1-W),$$

where W is a weight value, and $0 \leqq W \leqq 1$.

The weight value W is variously selected between 0 and 1 depending on the particular type of the concerned musical instrument. For instance, for flutes and pianos, the weight value W will be close to 1 (i.e., $0.5<W \leqq 1$); whereas for violins and various other treble instruments, the weight value W will be close to 0 (i.e., $0 \leqq W<0.5$).

Through the foregoing steps, the resultant timbre-optimized timbre sample allows the reproduction of a synthesized sound that is less monotonous and nearly without timbre vibrations. The timbre-balancing function therefore allows the reproduction of synthesized sounds with high timbre quality.

In conclusion, the method of the invention allows the resultant timbre samples to satisfy all of the four required conditions mentioned in the background section of this specification. The method of the invention thus can be used to build a database of timbre samples that allows the associated music synthesizer to produce synthesized sounds with high timbre quality.

The invention has been described using exemplary preferred embodiments. However, it is to be understood that the scope of the invention is not limited to the disclosed embodiments. On the contrary, it is intended to cover various modifications and similar arrangements. The scope of the claims, therefore, should be accorded the broadest interpretation so as to encompass all such modifications and similar arrangements.

What is claimed is:

1. A method of building a database of timbre samples from various musical instruments for a music synthesizer to produce synthesized sounds from the timbre samples, comprising the steps of:

setting a predetermined length for the timbre samples that are to be recorded from the various concerned musical instruments;

recording and digitizing the tones of the various concerned musical instruments to thereby obtain a number of primitive sound waveforms;

from the beginning point of each of the primitive sound waveforms, extracting the predetermined length of waveform to thereby obtain a first-prototype timbre sample;

selecting the minimum common multiple of the values of the various fundamental periods of the various timbre samples recorded from all of the concerned musical instruments as a standard looping-waveform length, and then selecting an endmost segment of the looping-waveform length from the end of the first-prototype timbre sample to thereby obtain a prototype looping waveform;

obtaining a preceding waveform segment of equal length to the prototype looping waveform; and then applying a cosine looping-waveform transformation function on the prototype looping waveform and the preceding waveform segment to thereby obtain an optimized looping waveform;

replacing the prototype looping waveform in the first-prototype timbre sample with the optimized looping waveform to thereby obtain a second-prototype timbre sample; and applying a timbre-balancing function on the second-prototype timbre sample and a third-prototype timbre sample having an optimized one-period looping waveform to thereby obtain a timbre-optimized timbre sample in accordance with:

$$X=T*W+S*(1-W),$$

where

X is the timbre-optimized timbre sample;

T is the third-prototype timbre sample;

S is the second-prototype timbre sample; and

W is a weight value, and $0 \leqq W \leqq 1$.

2. The method of claim 1, wherein in said step (2), the tones from the various concerned musical instruments are digitized at an equal sampling frequency.

3. The method of claim 1, wherein the total number of sampling points for the tones from the various concerned musical instruments are arbitrarily selected.

4. The method of claim 1, wherein the total number of sampling points for the tones from the various concerned musical instruments are the same.

5. The method of claim 1, wherein in said step (5), the cosine looping-waveform transformation function is mathematically expressed as:

$$F[k]=L[k]*\frac{1+\cos\left(\frac{k*\pi}{N}\right)}{2}+P[k]*\frac{1-\cos\left(\frac{k*\pi}{N}\right)}{2}$$

for $k = 1, 2, \ldots, N$ where

N is the total number of sampling points in the length of the prototype looping waveform;

F[1]-F[N] represent the N sampling points of the optimized looping waveform;

L[1]-L[N] represent the N sampling points of the prototype looping waveform; and P[1]-P[N] represent the N sampling points of the preceding waveform segment.

6. The method of claim 1, wherein the third-prototype timbre sample having optimized one-period looping waveform is obtained by the steps of:

obtaining an extracted waveform which is the second-prototype timbre sample excluding the endmost looping waveform;

applying the cosine looping-waveform transformation function on the first complete cycle of the fundamental period that immediately following the extracted waveform to thereby obtain an optimized one-period looping waveform; and repetitively appending the optimized one-period looping waveform to the end of the extracted waveform until the extended waveform is equal in length to the second-prototype timbre sample, the extended waveform of equal length to the second-prototype timbre sample serving as the third-prototype timbre sample.

7. The method of claim 1, wherein provided that the musical instruments are flutes and pianos, the weight value is in the range from 0.5 to 1; and provided that the musical instruments are violins and various other treble instruments, the weight value is in the range from 0 to 0.5.

8. A method of building a database of timbre samples from various musical instruments for a music synthesizer to produce synthesized sounds from the timbre samples, comprising the steps of:

recording and digitizing the tones of the various concerned musical instruments at a specific sampling frequency to obtain a number of primitive sound waveforms;

from the beginning point of each of the primitive sound waveforms, extracting a predetermined length of the waveform to thereby obtain a first-prototype timbre sample;

extracting an endmost segment of a predetermined length from the end of the first-prototype timbre sample to thereby obtain a prototype looping waveform;

obtaining a preceding waveform segment of equal length to the prototype looping waveform; and then applying a cosine looping-waveform transformation function on the prototype looping waveform and the preceding waveform segment to thereby obtain an optimized looping waveform;

replacing the prototype looping waveform in the first-prototype timbre sample with the optimized looping waveform to thereby obtain a second-prototype timbre sample;

extracting the first cycle of the fundamental period and a preceding waveform segment of equal length to the first cycle from the second-prototype timbre sample; and then the cosine looping-waveform transformation function on the two extracted waveforms to thereby obtain an optimized one-period looping waveform; and repetitively appending the optimized one-period looping waveform to the end of the third-prototype timbre sample until the extended waveform is equal in length to the second-prototype timbre sample to thereby obtain a third-prototype timbre sample.

applying a timbre-balancing function on the second-prototype timbre sample and the third-prototype timbre sample to thereby obtain a timbre-optimized timbre sample in accordance with:

$$X=T*W+S*(1-W),$$

where

X is the timbre-optimized timbre sample;

T is the third-prototype timbre sample;

S is the second-prototype timbre sample; and

W is a weight value, and $0 \leqq W \leqq 1$.

9. The method of claim 8, wherein in, the predetermined length of the first-prototype timbre sample is the same for all the various concerned musical instruments.

10. The method of claim 8, wherein the prototype looping waveform consists of a number of cycles of the fundamental period of the timbre sample.

11. The method of claim 8, wherein the length of the looping waveform is an integral multiple of the fundamental period of the timbre sample and less than the total length of the timbre sample.

12. The method of claim 8, wherein the length of the prototype looping waveform is the minimum common multiple of the values of the various fundamental periods of the various timbre samples recorded from all of the various concerned musical instruments.

13. The method of claim 8, wherein the cosine looping-waveform transformation function is mathematically expressed as:

$$F[k]=L[k]*\frac{1+\cos\left(\frac{k*\pi}{N}\right)}{2}+P[k]*\frac{1-\cos\left(\frac{k*\pi}{N}\right)}{2}$$

for $k = 1, 2, \ldots, N$ where

N is the total number of sampling points in the length of the prototype looping waveform;

F[1]-F[N] represent the N sampling points of the optimized looping waveform;

L[1]-L[N] represent the N sampling points of the prototype looping waveform; and P[1]-P[N] represent the N sampling points of the preceding waveform segment.

14. The method of claim 8, wherein provided that the musical instruments are flutes and pianos, the weight value is in the range from 0.5 to 1; and provided that the musical instruments are violins and various other treble instruments, the weight value is in the range from 0 to 0.5.

* * * * *

UNITED STATES PATENT AND TRADEMARK OFFICE

CERTIFICATE OF CORRECTION

PATENT NO. : 5,808,222
DATED : Septmber 15, 1998
INVENTOR(S) : Yang

It is certified that error appears in the above-identified patent and that said Letters Patent is hereby corrected as shown below:

On the title page: Item [30] Priority: should read inserted to read:

-- Foreign Application Priority Data July 16, 1997..... Taiwan, R.O.C.....86110059 --.

Signed and Sealed this

Second Day of March, 1999

*Attest:*

*Attesting Officer*

Q. TODD DICKINSON

*Acting Commissioner of Patents and Trademarks*